US008707744B2

(12) United States Patent
Wu et al.

(10) Patent No.: US 8,707,744 B2
(45) Date of Patent: Apr. 29, 2014

(54) LOCK HAVING SIMPLIFIED STRUCTURE

(71) Applicant: Sinox Co., Ltd, New Taipei (TW)

(72) Inventors: Chun-Sheng Wu, New Taipei (TW); Chia Ming Wu, New Taipei (TW)

(73) Assignee: Sinox Co., Ltd., New Taipei (TW)

( * ) Notice: Subject to any disclaimer, the term of this patent is extended or adjusted under 35 U.S.C. 154(b) by 0 days.

(21) Appl. No.: 13/923,363

(22) Filed: Jun. 20, 2013

(65) Prior Publication Data

US 2013/0340490 A1 Dec. 26, 2013

(30) Foreign Application Priority Data

Jun. 22, 2012 (TW) ..... 101212069 U

(51) Int. Cl.
*E05B 69/00* (2006.01)

(52) U.S. Cl.
USPC ..... 70/58; 70/428

(58) Field of Classification Search
USPC ..... 70/14, 18, 57–58, 423–428, DIG. 20
See application file for complete search history.

(56) References Cited

U.S. PATENT DOCUMENTS

| | | | | | |
|---|---|---|---|---|---|
| 505,299 | A * | 9/1893 | Schneider | 70/428 |
| 2,577,956 | A * | 12/1951 | Elsberg | 70/424 |
| 5,791,171 | A * | 8/1998 | Kelley | 70/58 |
| 5,913,907 | A * | 6/1999 | Lee | 70/58 |
| 6,058,744 | A * | 5/2000 | Ling | 70/28 |
| 6,257,029 | B1 * | 7/2001 | Liao | 70/58 |
| 6,449,992 | B1 * | 9/2002 | Yu et al. | 70/58 |
| 6,523,373 | B1 * | 2/2003 | Su | 70/58 |
| 6,619,080 | B1 * | 9/2003 | Yu | 70/58 |
| 6,619,081 | B1 * | 9/2003 | Yu | 70/58 |
| 6,672,117 | B2 * | 1/2004 | Yu | 70/58 |
| 6,880,373 | B2 * | 4/2005 | Ling | 70/58 |
| 6,918,272 | B1 * | 7/2005 | Sanders | 70/58 |
| 6,968,716 | B1 * | 11/2005 | Ling | 70/14 |
| 7,076,977 | B2 * | 7/2006 | Lee | 70/58 |
| 7,234,326 | B1 * | 6/2007 | Lu | 70/58 |
| 7,302,816 | B1 * | 12/2007 | Lu | 70/58 |
| 7,331,203 | B2 * | 2/2008 | Lee | 70/14 |
| 7,353,672 | B2 * | 4/2008 | Lu | 70/58 |
| 7,409,842 | B2 * | 8/2008 | Kuo | 70/58 |
| 7,428,834 | B1 * | 9/2008 | Lee | 70/57 |
| 7,635,272 | B2 * | 12/2009 | Poppe | 439/133 |
| 8,485,005 | B2 * | 7/2013 | Tsai | 70/58 |
| 2003/0106349 | A1 * | 6/2003 | Broadbridge et al. | 70/58 |
| 2007/0169523 | A1 * | 7/2007 | Lu | 70/58 |

* cited by examiner

*Primary Examiner* — Suzanne Barrett
(74) *Attorney, Agent, or Firm* — Cheng-Ju Chiang

(57) ABSTRACT

A lock includes a movable unit and a lock core structure including a restriction unit and a lock core. The restriction unit has a passage penetrating therethrough to form a first opening and a second opening on two opposite sides of the restriction unit. An extension wall is formed in the passage to face the second opening. The lock core is disposed in the passage to couple with the restriction unit and is selectively movable relative to the restriction unit in an axial direction. The lock core has an end face facing the extension wall and an extension portion disposed on one side of the lock core close to the first opening and selectively protruding outside the first opening. The movable unit selectively contacts the lock core and is able to reciprocally rotate, wherein rotation of the movable unit is linked to axial movement of the lock core.

10 Claims, 8 Drawing Sheets

LOCK HAVING SIMPLIFIED STRUCTURE

BACKGROUND OF THE INVENTION

1. Field of the Invention

The present invention generally relates to a lock having a simplified structure. Particularly, the present invention relates to a lock having a simplified lock core structure.

2. Description of the Prior Art

Consumer electronics play a very important role in the modern life. Fast lifestyle and eagerness for instant information make portable electronic devices become a necessity to most people. However, since these portable devices are in high demand, wide spread, high unit price, small volume, and high portability and become more and more popular, the possibility of being stolen or lost accordingly increases.

One type of locks is developed to against thieves. For example, laptop computer locks can connect the lock hole of electronic devices by a latch unit. In particular, when the lock is in the unlocked state, the latch unit can be controlled to change its status. Under different statuses, the latch unit can be inserted into or retreated from the lock hole or can be engaged with the lock hole. When the lock is in the locked state, the latch unit is not controllable, being locked to a certain status. Under such a status, the electronic device is secured by the lock due to the engagement of the latch unit with the lock hole.

As shown in FIG. 1A, a conventional lock 1 for electronic devices has a fixing unit 41 and a latch unit 60, wherein the latch unit 60 can operably rotate and has a latch end 63 that forms an engaging unit with the fixing unit 41 for connecting the lock hole. When the latch unit 60 rotates, the latch end 63 moves relative to the fixing unit 41 along a path approximately parallel to the path D and toward the indentation 41*a* of the fixing unit 41 and is finally received in the indentation 41*a*. When the latch end 63 is received in the indentation 41*a*, the engaging unit has a minimum space for accessing the lock hole. When the latch end 63 is retreated from the indentation 41*a*, the engaging unit occupies a larger space that is not allowed to enter the lock hole. As shown in FIGS. 1B-1C, rotation of the latch unit 60 with respect to the rotation axis C is controlled by the lock core structure including the seat units 2*a*, 2*b* and the lock core 5. The lock core 5 can move relative to the latch unit 60 in an axial direction "i" under lock or unlock operations. The lock core 5 has a driving part 57 and the latch unit 60 has a driven part 61. When the lock core 5 is pushed to move toward the latch unit 60, the driving part 57 pushes the driven part 61, such that latch unit 60 can rotate due to lever principle. Meanwhile, as shown in FIG. 1C, the elastic elements 7*b*, 7*c* are compressed and will release the elastic force at a proper timing to facilitate the reverse rotation of the latch unit 60, causing the latch end 63 to move toward the indentation 41*a* along a path about parallel to the path D, and to push the lock core 5 to displace away from the latch unit 60 along the direction M. The conventional lock core structure further includes a pin 8, and the lock core is formed with a long-narrowed space 59 and a restriction hole 55. The pin 8 penetrates through the restriction hole 55 and enters the space 59. The seat unit 2*a* is formed with a through hole 21 for receiving the pin 8. Two ends of the elastic element 7*b* respectively contact the pin 8 and the inner wall of the space 59 to facilitate the displacement of the lock core 5 away from the latch unit 60. The arrangement of the pin 8 and the restriction hole 55 can control the range of axial displacement of the lock core 5, such that the lock core 5 will not move too far away from the latch unit 60, thus causing malfunction.

However, in the lock core structure of the conventional lock 1, to complete the arrangement of pin 8, lock core 5, and seat unit 2*a* must require appropriate mechanical techniques and proper manufacture steps. Considering the complexity of techniques and procedures, simplifying the lock core structure is desired.

SUMMARY OF THE INVENTION

It is an object of the present invention to provide a lock having a simplified structure to simplify the production process and reduce the production cost.

In one aspect, the present invention provides a lock including a lock core structure and a movable unit, wherein the lock core structure controls rotation of the movable unit. The lock core structure includes a restriction unit and a lock core. The restriction unit has a passage penetrating therethrough to form a first opening and a second opening on two opposite sides of the restriction unit. In addition, an extension wall is formed in the passage to face the second opening. The lock core is disposed in the passage to couple with the restriction unit and is movable relative to the restriction unit in an axial direction. The lock core further includes an end face and an extension portion, wherein the end face and the extension wall are disposed in the passage in a manner that the end face faces the extension wall. The extension portion of the lock core is disposed on one side of the lock core that is close to the first opening and selectively protrudes outside the first opening. In addition, the movable unit is disposed on one side of the restriction unit that has the first opening and selectively couples with the lock core. The movable unit can perform a reciprocal rotation within a given angle.

The lock core structure further includes an elastic unit disposed between the end face and the extension wall, wherein deformation of the elastic unit is linked to axial movement of the lock core. The axial movement of lock core can drive the end face to move toward the extension wall and also compress the elastic unit. Similarly, the elastic unit can release an elastic force to push the end face so as to drive the lock core to axially move in a reverse direction. The movable unit selectively couples with the lock core in the axial direction and has a rotation axis perpendicular to the axial direction, wherein the axial movement of the lock core toward the movable unit can drive the movable unit to rotate.

The restriction unit of the lock core structure further has a notch formed under the extension wall to communicate with the first opening and the second opening, wherein the extension portion of the lock core passes through the notch and reciprocally moves in the notch. In addition, the restriction unit further has a stop zone formed in the passage and on one side of the notch that is away from the first opening. The extension portion stops at the stop zone so as to restrict movement of the lock core away from the movable unit. Moreover, the extension portion of the lock core further includes a driving part and the movable unit includes a driven part adjacent to the driving part. As the lock core moves toward the movable unit, the driving part pushes the driven part away from the notch so as to drive the movable part to rotate. Similarly, movement of the lock core away from the movable unit indirectly or directly drives the driven part to move toward the notch so as to drive the movable unit to rotate in a reverse direction.

The restriction unit mainly consists of a first seat unit and a second seat unit connected in series, wherein the notch is formed in the first seat unit; the stop zone is a surface of the second seat unit connected to the first seat unit. In addition, the restriction unit further has a through hole substantially crossing the axial direction and communicating with the passage. The lock core further has a groove on its surface to selectively correspond to the through hole. Moreover, the lock core structure further includes a movable pin movably disposed in the through hole. A portion of the movable pin moves into the groove corresponding to the through hole to limit movement of the lock core toward the movable unit.

The lock of the present invention further includes a shell part fitted on the lock core structure and a portion of the movable unit. The shell part has a fixing unit disposed on one side of the lock core structure that is connected to the movable unit. The moveable part can rotate with respect to the fixing unit. Moreover, the fixing unit has an indentation. The movable unit has a latch end. The movable unit reciprocally rotates to drive the latch end to move relative to the indentation, wherein the latch end moves toward the indentation and is received in the indentation.

BRIEF DESCRIPTION OF THE DRAWINGS

FIGS. 1A-1C illustrate schematic views of the conventional lock core structure, wherein FIG. 1C is a cross-sectional view along the line A-A' of FIG. 1A;

DETAILED DESCRIPTION OF THE PREFERRED EMBODIMENT

Figure 1A:
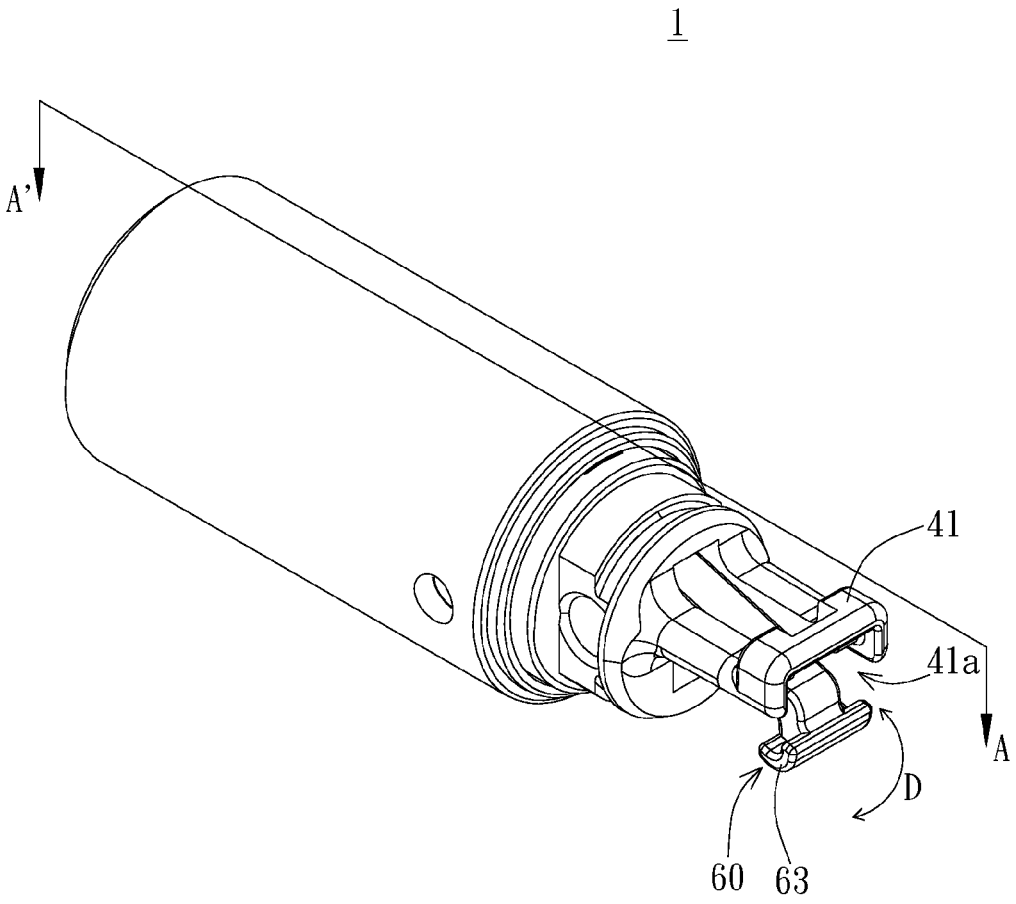
FIG. 1A (PRIOR ART)
Figure 1B:
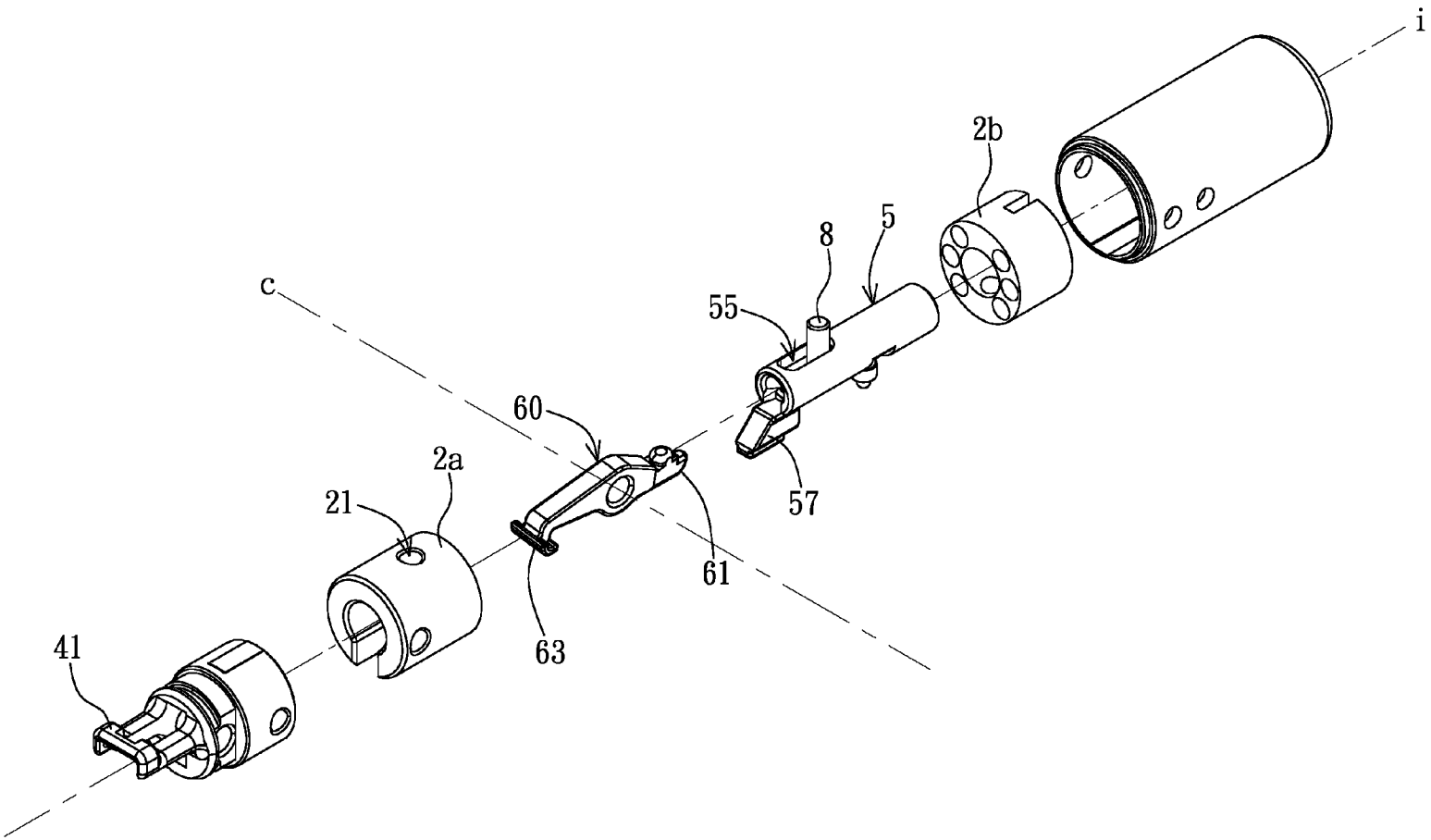
FIG. 1B (PRIOR ART)
Figure 1C:
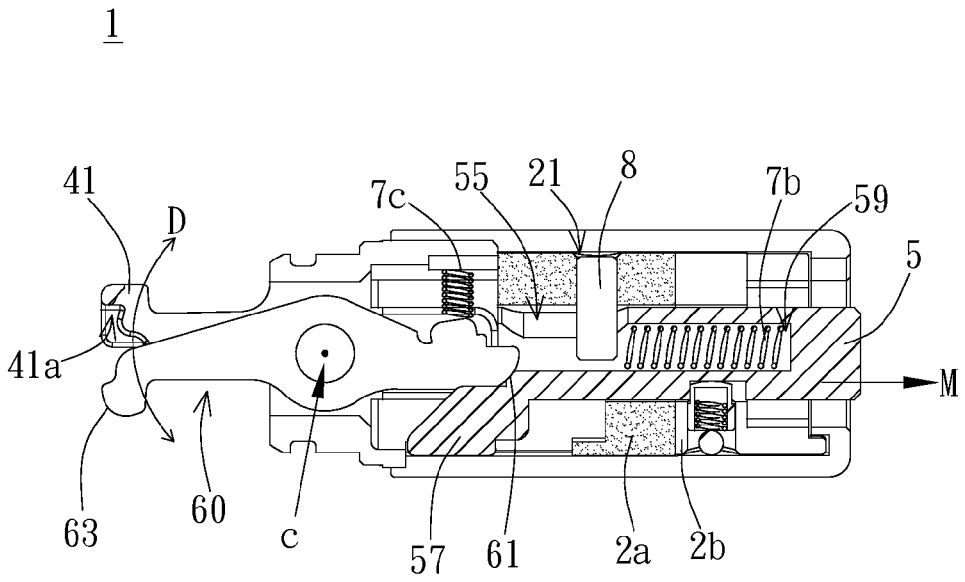
FIG. 1C (PRIOR ART)
Figure 2:
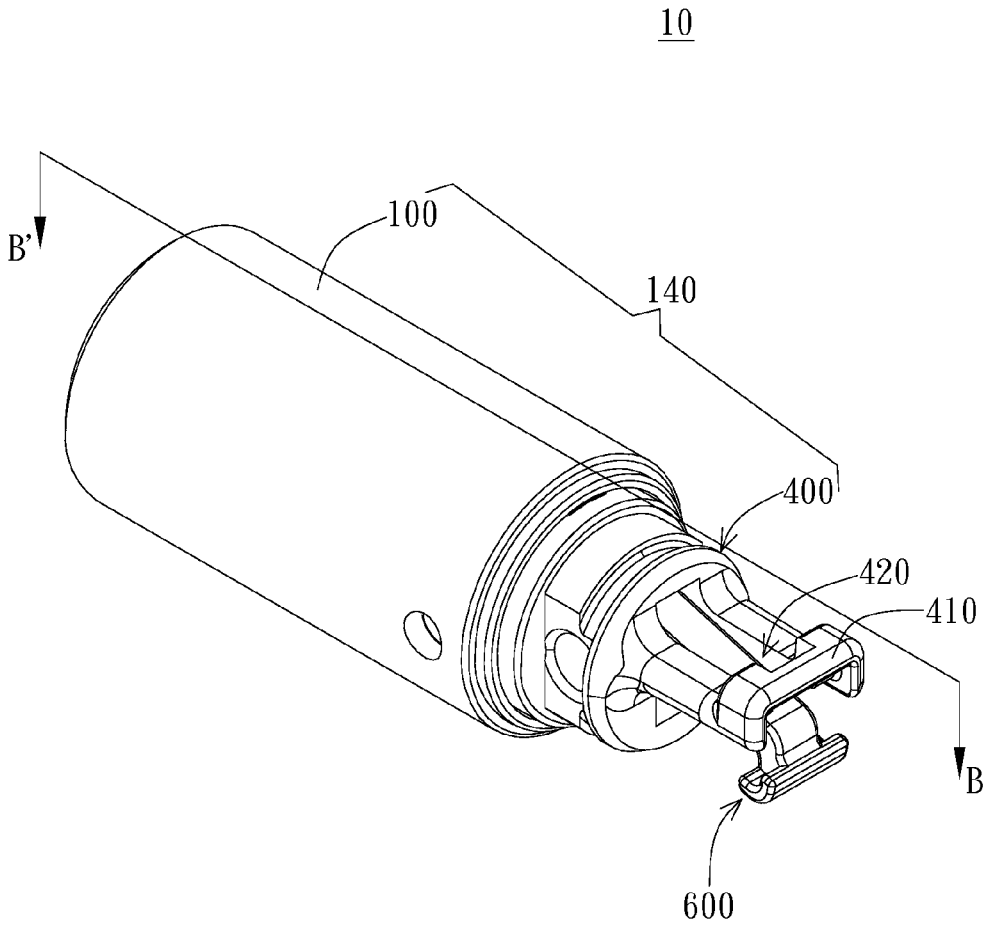
FIG. 2 is a schematic view of an embodiment of the lock of the present invention.
Figure 3A:
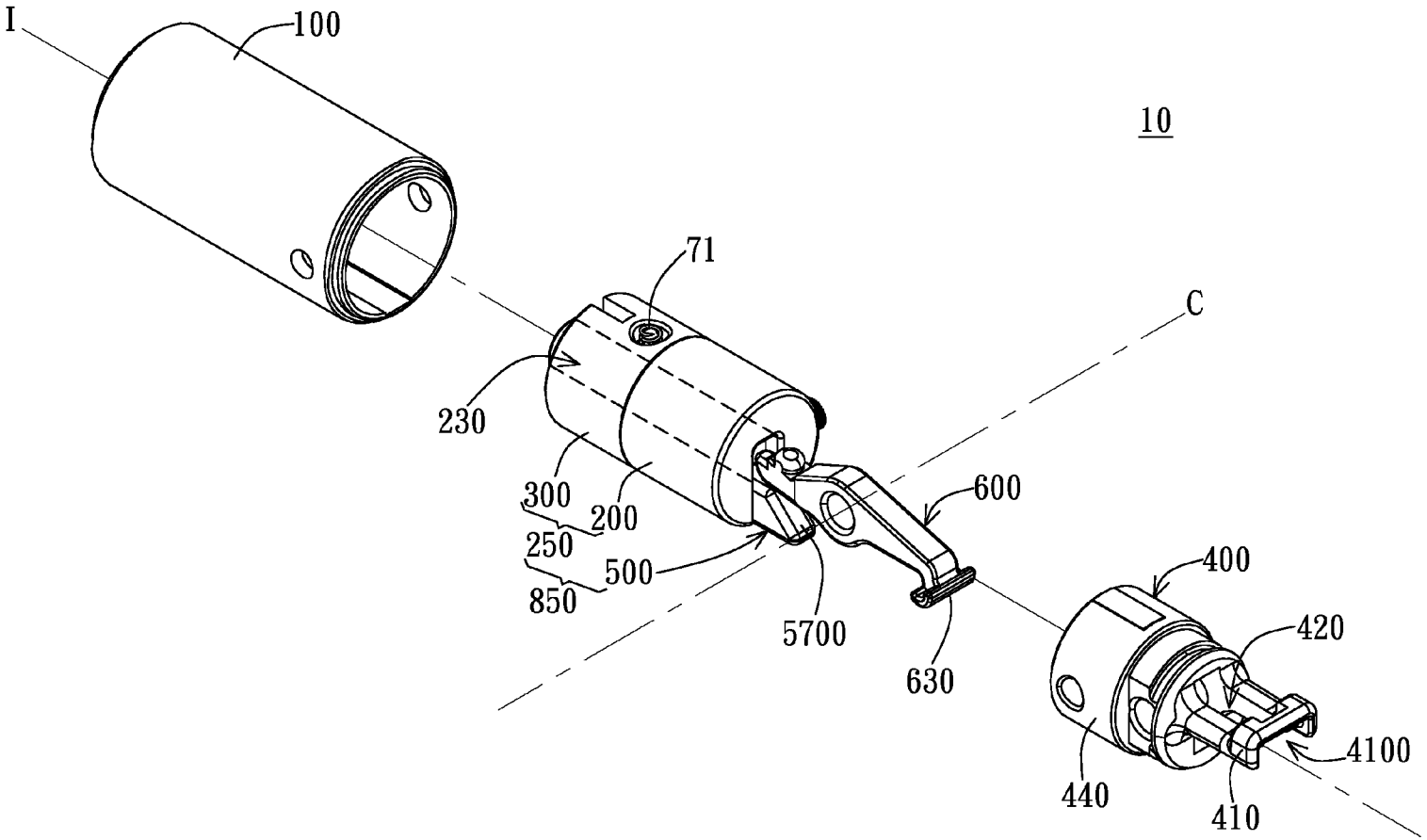
FIG. 3A is a partially exploded view of an embodiment of the lock of the present invention.

As shown in FIGS. 2 and 3A, an embodiment of the lock 10 of the present invention preferably includes a shell part 140 consisting of a first shell 100 and a second shell 400, a movable unit 600, and a lock core structure 850 consisting of a restriction unit 250 and a lock core 500. The movable unit 600 selectively contacts the lock core 500 and can perform a reciprocal rotation with respect to a rotation axis C. In addition, the rotation axis C is preferably perpendicular to an axial direction I of the lock core 500. The second shell 400 is hollow and has a fixing unit 410 of U shape formed in one end. The second shell 400 couples with the restriction unit 250 along the axial direction I and is fitted on a portion of the movable unit 600. The U-shaped fixing unit 410 and the body 440 of the second shell 400 together enclose a rectangular ring portion 420 to provide a proper space required for the reciprocal rotation of the movable unit 600. The first shell 100 is fitted on the restriction unit 250 and the body 440 of the second shell 400 and fixed thereon by a pin or bolt to secure and protect the restriction unit 250 and the movable unit 600. The exposed hole such as through hole (will be described later) on the surface of the second shell 400 and the restriction unit 250, incorporated with the first shell 100, can fix elements such as movable pin in the exposed hole. In addition, the fixing unit 410 and a portion of the movable unit 600 are not enclosed by the first shell 100 and are preferably exposed outside to form a latch unit of the lock 10 so as to connect the lock hole.

Figure 3B:
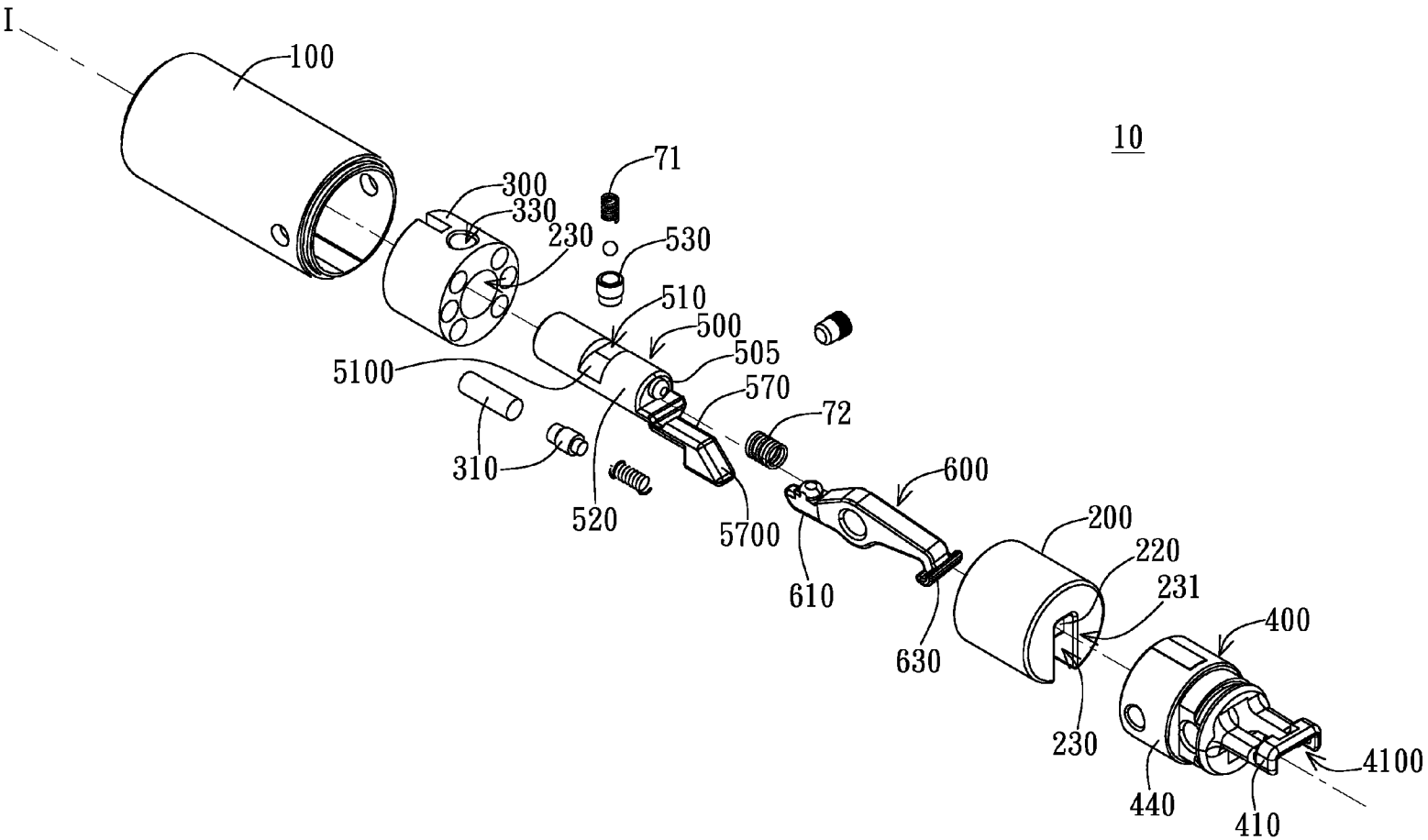
FIG. 3B is an exploded view of an embodiment of the lock of the present invention.
Figure 4A:
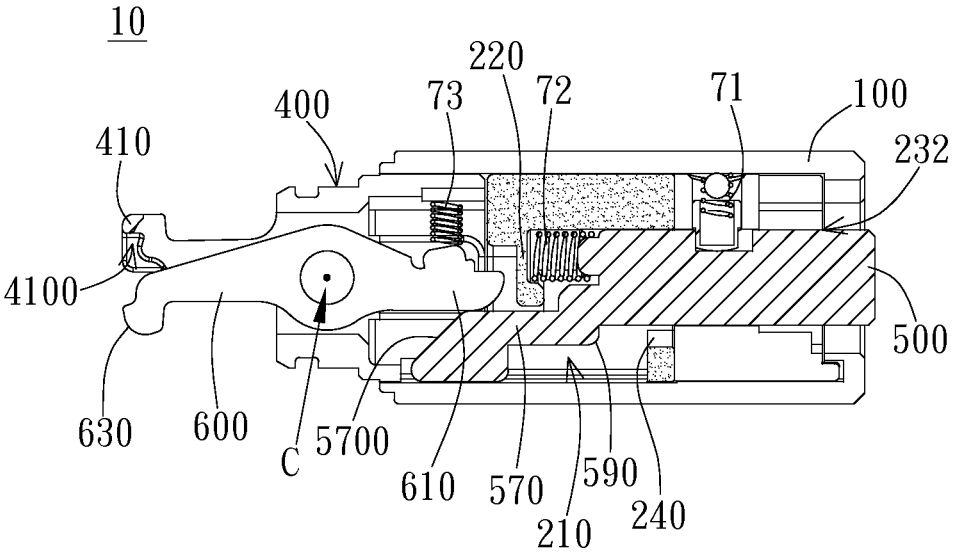
FIG. 4A is a schematic cross-sectional view along the line B-B' of FIG. 3B.

Moreover, in the embodiment of the present invention, as shown in FIG. 3B, the restriction unit 250 is formed with a passage 230 that penetrates through the restriction unit 250. The lock core 500 couples with the restriction unit 250 through the passage 230 and is selectively movable relative to the restriction unit 250 in an axial direction. In particular, the restriction unit 250 preferably controls axial movement of the lock core 500, wherein the axial movement of the lock core 500 can drive the movable unit 600 to rotate. Further, the lock core structure of the present invention can be, for example, a lock core structure for four-sided key lock. In such a case, the restriction unit 250 can include a first seat unit 200 and a second seat unit 300. The first seat unit 200 serves as a stationary seat unit while the second seat unit 300 serves as a movable seat unit and is connected to the stationary seat unit in series. As shown in FIGS. 3B and 4A, the passage 230 forms a first opening 231 on one side of the first seat unit 200 that is opposite to the side connected to the second seat unit 300 and a second opening 232 on one side of the second seat unit 300 that is opposite to the side connected to the first seat unit 200. Similar to the conventional lock core structure of key lock, the seat unit is disposed with a seat core 310 that can interact with the key. Thereby, the key can drive the movable seat unit 300 to rotate so as to release the lock core 500, i.e. to perform unlock process. In the embodiment, the lock core 500 selectively contacts the movable unit 600 at a place close to the first opening 231 of the first seat unit 200. The release of the lock core 500 means that the lock core 500 can move away from the movable unit 600 and thus directly or indirectly cause the movable unit 600 to rotate. The rotation of the movable unit 600 preferably makes the movable unit 600 be able to enter or leave the lock hole together with the fixing unit 410.

As shown in FIG. 3B, the lock core 500 of the present invention preferably includes a body 520 that is in a shaft shape and has a round columnar side surface and an extension portion 570 that extends from the body 520 and is disposed to one side of the lock core 500 close to the movable unit 600, wherein shape and size of the body 520 preferably correspond to the passage 230. One end of the extension portion 570 that is close to the movable unit 600 is formed as a wedge block having an inclined face to serve as the driving part 5700. Moreover, the movable unit 600 includes a driven part 610 and a latch end 630. The movable unit 600 can be pivotally secured to the fixing structure of the lock 10 (e.g. the body 440 of the second shell 400) by a portion between the driven part 610 and the latch end 630 (e.g. substantially the center portion of the movable unit 600). Thus, the fixing portion serving as a pivot and a rotation axis C, the movable unit 600 can act based on the lever principle. For example, when the lock core 500 moves toward the movable unit 600 and the driving part 5700 pushes the driven part 610 through the inclined face, one side of the movable unit 600 that has the driven part 610 moves in a direction substantially perpendicular to the pushing direction, i.e. moving upwards, and the latch end 630 descends. In contrast, when the driving part 5700 no longer touches against the driven part 610, such as the lock core 500 moving away from the movable unit 600 and one side of the movable unit 600 having the driven part 610 descending upon a downward force, the latch end 630 will ascend. In the preferred embodiment of the present invention, the fixing unit 410 is formed with an indentation 4100 facing toward the latch end 630 of the movable unit 600. The facing direction of the indentation 4100 and the pushing force of the driving part 5700 is substantially opposite to the displacement direction of the latch end 630. That is, the reciprocal rotation of the movable unit 600 causes the latch end 630 to move relative to the indentation 4100, wherein the latch end 630 moves toward the indentation 4100 to be received in the indentation 4100. In such a configuration, the latch unit occupies a minimum space, being able to enter or leave the lock hole. When the latch end 630 moves away from the indentation 4100 farthest, the latch unit engages with the lock hole and is retained in the lock hole.

Figure 3C:
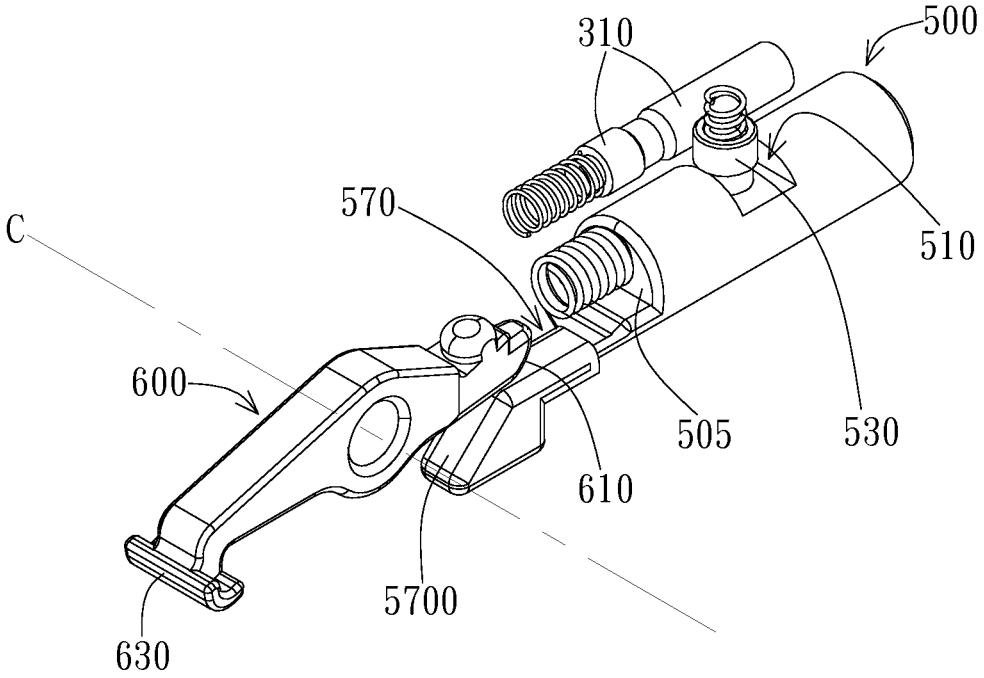
FIG. 3C is a schematic view of a portion of the lock of the present invention.

As shown in FIGS. 3B-3C and 4A-4B, the lock core 500 preferably further includes a groove 510 formed in the surface thereof, a movable pin 530 capable of partially moving into the groove 510, an end face 505, and a stopping portion 590. The restriction unit 250 preferably further includes an extension wall 220, a notch 210, a stop zone 240, and a through hole 330. The though hole 330 receives the movable pin 530, substantially crosses the axial direction I, and communicates with the passage 230 so as to control the axial movement of the lock core 500. In particular, as shown in FIGS. 3C and 4A, after the lock core 500 moves toward the movable unit 600 and the driving part 5700 pushes the driven part 610, the latch end 620 descends and moves away from the indentation 4100 farthest. In other embodiments, the latch end 630 can ascend to move away from an upward-faced indentation. In addition, the groove 510 formed in the surface of the shaft shaped body 520 corresponds to the through hole 330. The movable pin 530 in the through hole 330 can be pushed in a direction substantially perpendicular to the axial direction I toward the lock core 500 by means of the elastic element 71 and partially move into the groove 510 so as to hold the lock core 500 and the restriction unit 250 in a relative position. That is, the driving part 5700 is maintained at the state of pushing against the driven part 610. Thus, when the latch unit is in the lock hole, the lock 10 is secured to the electronic product by the fixing unit 410, the latch end 630, and the lock hole.

The through hole 330 is preferably formed in the second seat unit 300, i.e. the movable seat unit, and the inner space of the through hole 330 is preferably in a size capable of restricting the movement of the movable pin 530 in the hole with respect to the wall of the through hole 330. Moreover, as shown in FIG. 3B, the groove 510 is disposed substantially along the rotation direction of the movable seat unit and the bottom of the groove 510 is preferably formed as a convex curved surface 5100, while the side surface connecting the shaft shaped body 520 is formed relatively smoother, wherein the groove wall close to the connection is lower. That is, the convex curved surface 5100 can be considered as a transition zone between the groove 510 and the body 520. When the key acts on the lock core structure, such as interacting with the seat core 310 of the seat unit, the conventional movable seat unit will rotate, driving the movable pin 530 to rotate as well; the movable pin 530 enters the transition zone constituted by the convex curved surface 5100 so that the lock core 500 is released from the engagement state. Sequentially referring to FIGS. 4A and 4B, the elastic element 72 disposed at a proper location can push the lock core 500 to move away from the movable unit 600 by touching against the lock core 500, thus the driving part 5700 no longer touching against the driven part 610. In the embodiment, the elastic element 73 disposed at a proper location can push one side of the movable unit 600 having the driven part 610 downward by touching against the side of the movable unit 600 having the driven part 610, so that the latch end 630 will ascend and is finally received in the indentation 4100 that faces downward. In other embodiments, the latch end 630 descends to be received in an upward-faced indentation.

Figure 4B:
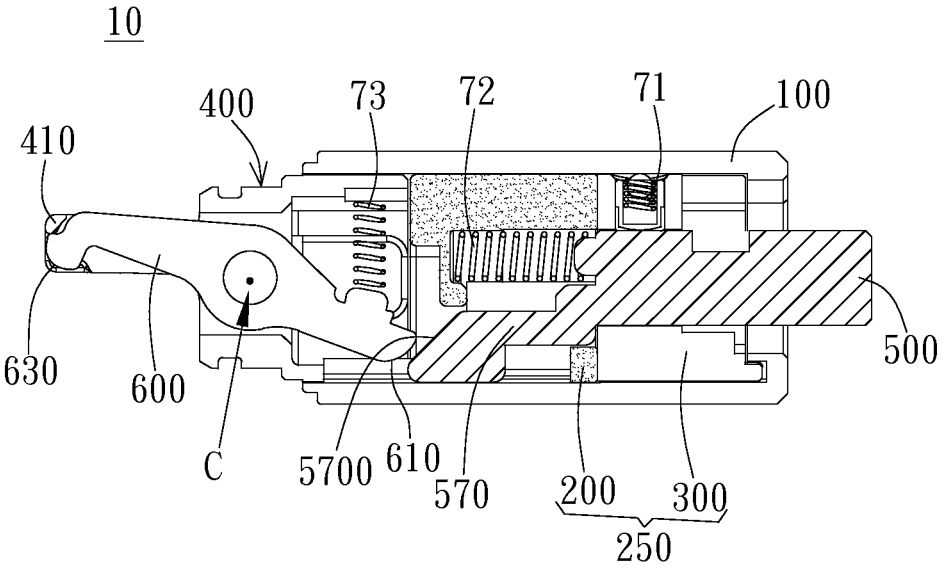
FIG. 4B is a schematic cross-sectional view of an embodiment of the lock in another state of the present invention.

In an embodiment of the present invention, an extension wall 220 is formed in the passage 230 of the restriction unit 250, preferably in the passage 230 and within the stationary seat unit 200, and faces the second opening 232, wherein the extension wall 220 can be located at the distal end of the passage 230 to reduce the first opening 231. Alternatively, as shown in FIGS. 3B and 4A-4B, the extension wall 220 extends from the inner wall of the passage 230 with two sides respectively face the first opening 231 and the second opening 232 and is positioned a distance away from the first opening 231. In addition, the stationary seat unit 200 further has a notch 210, wherein the notch 210 is formed from the surface of the seat unit 200 toward the inner side to communicate with the passage 230 as well as the first opening 231 and the second opening 232. The notch 210 preferably further extends along the axial direction I. That is, one side of the stationary seat unit 200 is formed with a long-narrowed notch 210 communicating with the passage 230. The width of the notch 210 along the radial direction is preferably larger than the length of the extension portion 570 of the lock core 500 in the same direction. The extension portion 570 passes through the notch 210 and can reciprocally move within the notch 210. The driving part 5700 is preferably able to protrude outside the first opening 231 and acts together with the movable unit 600. Furthermore, the end face 505 of the lock core 500 is disposed in the passage 230 in a manner that the end face 505 faces the extension wall 220 and the elastic element 72 is disposed between the end face 505 and the extension wall 220. The deformation of the elastic element 72 is linked to the axial movement of the lock core 500. In particular, when the lock core 500 moves toward the movable unit 600, the lock core 500 also moves relative to the restriction unit 250, so that the end face 505 moves toward the extension wall 220 to compress the elastic element 72. When the key acts on the lock core structure 850 to release the lock core 500 from the engagement state, the compressed elastic element 72 can be released to provide elastic force to push the lock core 500 to move away from the movable unit 600. The movement of the lock core 500 toward the movable unit 600 preferably occurs upon a user pressing the lock core 500.

In addition to the movement of the lock core 500 toward the movable unit 600 stopping at the engagement of the movable pin 530 and the groove 510, the distance that the lock core 500 moves away from the movable unit 600 can also be controlled. As described above, the lock core 500 includes the stopping portion 590; the restriction unit 250 is formed with the stop zone 240. As shown in FIGS. 3B and 4A-4B, the stopping portion 590 of the lock core 500 is preferably disposed on one side of the extension wall 570 opposite to the driving part 5700, such as a stepped protrusion on the surface of the body 520. The stop zone 240 can be formed within the notch 210, preferably on one end of the notch 210 away from the first opening 231. That is, one side surface of the second seat unit 300 adjacent to the first seat unit 200 can serve as the stop zone 240. The lock core 500 moves in the passage 230 away from the movable unit 600 and stops as the stopping portion 590 touches against the stop zone 240. Meanwhile, the lock core 500 also moves away from the movable unit 600. The position that the lock core 500 stops at the stop zone 240 preferably allows the driving part 5700 to move completely outside the contactable range of the driven part 610. It depends upon the location of the stop zone, the length of the notch, or the design of stopping portion.

Furthermore, since the elastic element 73 disposed at the corresponding location of the lock core 500 can move toward the movable unit 600 and is compressed as the driving part 5700 pushes the driven part 610 by the inclined face, when the driving part 5700 moves outside the contactable range of the driven part 610, the elastic element 73 can push one side of the movable unit 600 having the driven part 610 by touching against the side of the movable unit 600 having the driven part 610, allowing the latch end 630 to ascend. Moreover, since the extension portion 570 of the lock core 500 passes through the notch 210, when the driving part 5700 moves toward the first opening 231 and acts together with the movable unit 600, the movement of the lock core 500 away from the movable unit 600 will cause the driving part 5700 to move into the notch 210 through the first opening 231, allowing the driven part 610 to move toward the communicating direction of the first opening 231 and the notch 210. When the movement of the lock core 500 toward the movable unit 600 causes the driving part 5700 to protrude outside the first opening 231 and push the driven part 610, the driven part 610 is driven to move away from the notch 210.

In general, the lock core 500 including the body 520, the extension portion 570, the end face 505, and the groove 510 preferably has a closed outer surface, wherein the groove 510 is a shallow trench formed in the surface of the body 520 and considered as a portion of the outer surface. In particular, the lock core 500 of the present invention is preferably a solid structure, instead of a hollow tube having a receiving inner space enclosed by an inner surface. That is, the lock core 500 of the present invention is disposed with no restriction hole, simplifying the manufacture process and the lock core structure. Moreover, the restriction unit 250 of the present invention, such as the first seat unit 200, has no through hole to allow the restriction pin to pass therethrough for controlling the axial displacement of lock core. That is, the restriction unit 250 of the present invention has a simplified structure and a highly workable manufacture process. In addition, the simplified structure of the lock core 500 and the restriction unit 250 of the present invention also simplifies the assembly of the lock and reduces the assembly time of the lock.

Although the preferred embodiments of present invention have been described herein, the above description is merely illustrative. The preferred embodiments disclosed will not limit the scope of the present invention. Further modification of the invention herein disclosed will occur to those skilled in the respective arts and all such modifications are deemed to be within the scope of the invention as defined by the appended claims.

What is claimed is:

1. A lock, comprising:

a lock core structure, comprising:

a restriction unit having a passage penetrating therethrough to form a first opening and a second opening on two opposite sides of the restriction unit, wherein an extension wall is formed in the passage to face the second opening;

a lock core disposed in the passage, the lock core being movable relative to the restriction unit in an axial direction and comprising:

an end face facing the extension wall; and an extension portion disposed on one side of the lock core close to the first opening, the extension portion extending under the extension wall toward the first opening and selectively protruding outside the first opening; and an elastic unit disposed between the end face and the extension wall, two ends of the elastic unit respectively contacting the end face and the extension wall; and a movable unit selectively contacting the lock core and capable of performing a reciprocal rotation, rotation of the movable unit is linked to axial movement of the lock core;

wherein the elastic unit releases an elastic force to push the end face so as to drive the lock core to move relative to the restriction unit and away from the movable unit.

2. The lock of claim 1, wherein the movable unit selectively couples with the lock core in the axial direction and has a rotation axis perpendicular to the axial direction.

3. The lock of claim 1, wherein the restriction unit has a notch formed under the extension wall; the notch communicates with the first opening and the second opening; the extension portion of the lock core passes through the notch and reciprocally moves in the notch; the restriction unit further has a stop zone formed in the passage and on one side of the notch away from the first opening; the extension portion moves away from the movable unit and stops at the stop zone.

4. The lock of claim 3, wherein the restriction unit comprises a first seat unit and a second seat unit connected in series; the notch is formed in the first seat unit; the stop zone is a surface of the second seat unit connected to the first seat unit.

5. The lock of claim 1, wherein the restriction unit further has a through hole substantially crossing the axial direction and communicating with the passage; the lock core further has a groove selectively corresponding to the through hole.

6. The lock of claim 5, wherein the lock core structure further comprises a movable pin movably disposed in the through hole; a portion of the movable pin moves into the groove corresponding to the through hole to limit movement of the lock core.

7. The lock of claim 1, wherein the lock core has a closed outer surface.

8. The lock of claim 1, further comprising a fixing unit disposed on one side of the lock core structure that is connected to the movable unit.

9. The lock of claim 8, wherein the fixing unit has an indentation; the movable unit has a latch end; the movable unit reciprocally rotates to drive the latch end to move relative to the indentation; the latch end moves toward the indentation and is received in the indentation.

10. The lock of claim 8, further comprising a shell part fitted on the lock core structure and a portion of the movable unit, wherein the fixing unit is a portion of the shell part.

* * * * *